US005852959A

United States Patent [19]

Speare

[11] Patent Number: 5,852,959

[45] Date of Patent: Dec. 29, 1998

[54] NAIL STARTER FOR A HAMMER

[76] Inventor: William Speare, 669 Jackson Pkwy., Williams Bay, Wis. 53191

[21] Appl. No.: 662,922

[22] Filed: Jun. 13, 1996

[51] Int. Cl.[6] ..... B25D 1/04

[52] U.S. Cl. ..... 81/23; 81/44

[58] Field of Search ..... 81/23, 24, 44; 7/146, 147; D8/78, 80, 81, 395–397; 248/74.1, 74.2; 24/336, 331

[56] References Cited

U.S. PATENT DOCUMENTS

| | | | |
|---|---|---|---|
| D. 299,213 | 1/1989 | Puntillo | D8/395 |
| D. 319,567 | 9/1991 | Furey | D8/80 |
| 735,877 | 8/1903 | Horton | 81/23 |
| 2,574,304 | 11/1951 | Vigil | 81/23 |
| 3,788,373 | 1/1974 | Aherin . | |
| 4,193,433 | 3/1980 | Sickler . | |
| 4,270,587 | 6/1981 | Ludy . | |
| 4,273,172 | 6/1981 | Hoosier . | |
| 4,658,579 | 4/1987 | Nitzberg et al. | 81/23 |
| 4,798,107 | 1/1989 | Furey | 81/23 |
| 4,843,925 | 7/1989 | Furey | 81/23 |

FOREIGN PATENT DOCUMENTS

| | | | |
|---|---|---|---|
| 203924 | 9/1920 | Canada | 81/23 |

*Primary Examiner*—D. S. Meislin
*Attorney, Agent, or Firm*—Michael Best & Friedrich LLP

[57] ABSTRACT

A nail starter for a hammer includes an attachment for the head of the hammer or at least one integral protrusion for defining a pocket that receives the head of a nail. The starter may further include a spring member for releasably holding the body of the nail in a predetermined position.

4 Claims, 2 Drawing Sheets

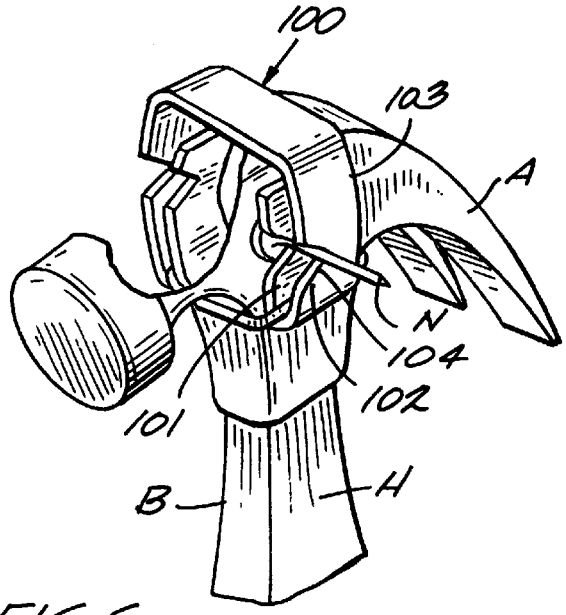
FIG. 6
FIG. 7
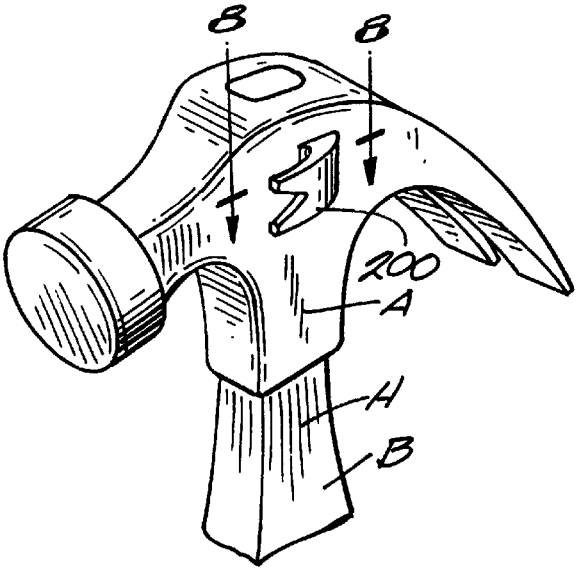
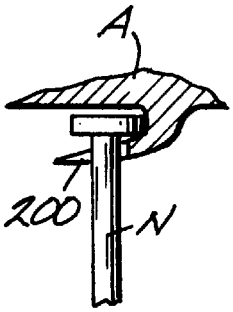
FIG. 8
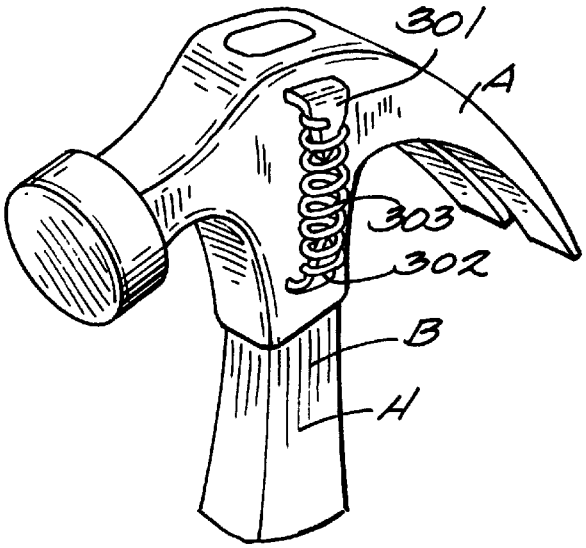
FIG. 9

NAIL STARTER FOR A HAMMER

BACKGROUND OF THE INVENTION

1. Field of the Invention

The present invention generally relates to a nail starter for a hammer, and more specifically to a nail starter that releasably secures a nail to a side of the hammer's head and allows a user to start driving the nail into a receiving body.

2. Description of the Prior Art

The prior art includes a variety of hammer attachments designed to releasably secure a nail to a hammer and facilitate the "starting" of the nail, i.e., the initial penetration of the nail to a receiving body. U.S. Pat. No. 4,270,587 titled "Nail Holder For Hammer" and issued on Jun. 2, 1981 to Lundy, describes such an attachment. The Lundy attachment includes a pair of spring arms that extend around the handle of the hammer and a pair of cantilever members. The cantilever members lie proximate the head of the hammer in overlapping relation. They hold the head of a nail between their end portions.

Other prior art references that disclose attachments similar to the Lundy attachment include: United States Design Pat. No. Des. 299,213 to Puntillo; United States Design Pat. No. Des. 319,567; U.S. Pat. No. 4,798,107 to Furey; U.S. Pat. No. 4,658,679 to Nitzberg et al.; and U.S. Pat. No. 3,788,373 to Aherin. Still other prior art references such as U.S. Pat. No. 4,273,172 to Hoosier and U.S. Pat. No. 4,193,433 to Sickler disclose hammers with heads that include integrally formed structure that releasably secures a nail so that the nail extends outwardly of the front or rear of the head.

The devices and structure disclosed in those references do not provide a suitable means of securely holding a nail on the head of a hammer. In contrast, the nail starter of the present invention releasably secures a nail with the head of the nail disposed against the head of the hammer and the body of the nail supported in such a manner that a user may easily drive it into a receiving body. It is a simple construction that minimizes the cost of manufacture and allows the quick and easy starting of nails.

SUMMARY OF THE INVENTION

In accordance with one embodiment of the present invention, a nail starter includes a body member that defines a pocket for releasably receiving a portion of the hammer. This body includes a first portion for holding the head of a nail against the head of the hammer and a second portion disposed a spaced distance away from the first portion. The first and second portions include means for holding a nail outwardly of the hammer along a predetermined direction. The means for holding the nail includes a notch formed into the first portion, a groove formed into the second portion, and/or a spring member disposed across the groove of the second portion.

In another embodiment of the present invention, the nail starter includes at least one protrusion integrally formed with the head of the hammer. The protrusion and the main body of the hammer head define a pocket for receiving the head of a nail. In yet another embodiment, a spring supported by a pair of integrally formed protrusions may support the nail by engaging the body of the nail and holding it in a predetermined position.

BRIEF DESCRIPTION OF THE DRAWINGS

For a more complete understanding of this invention, one should now refer to the embodiments illustrated in greater detail in the accompanying drawings and described below by way of an example of the invention. In the drawings:

FIG. 6 is a perspective view of a hammer and a second embodiment of the nail starter device of the present invention;

FIG. 7 is a perspective view of a hammer with a third embodiment of the nail starter device of the present invention;

FIG. 8 is a sectional view taken along line 8—8 in FIG. 7; and

FIG. 9 is a perspective view of a hammer with a fourth embodiment of the nail starter structure of the present invention.

While the following disclosure describes the invention in connection with a number of embodiments and modifications, one should understand that the invention is not limited to these embodiments and modifications. Furthermore, one should understand that the drawings are not to scale and that graphic symbols, diagrammatic representatives, and fragmentary views, in part, may illustrate the embodiment and modifications. In certain instances, the disclosure may not include details which are not necessary for an understanding of the present invention such as conventional details of fabrication and assembly.

DETAILED DESCRIPTION OF THE DRAWINGS

Figure 1:
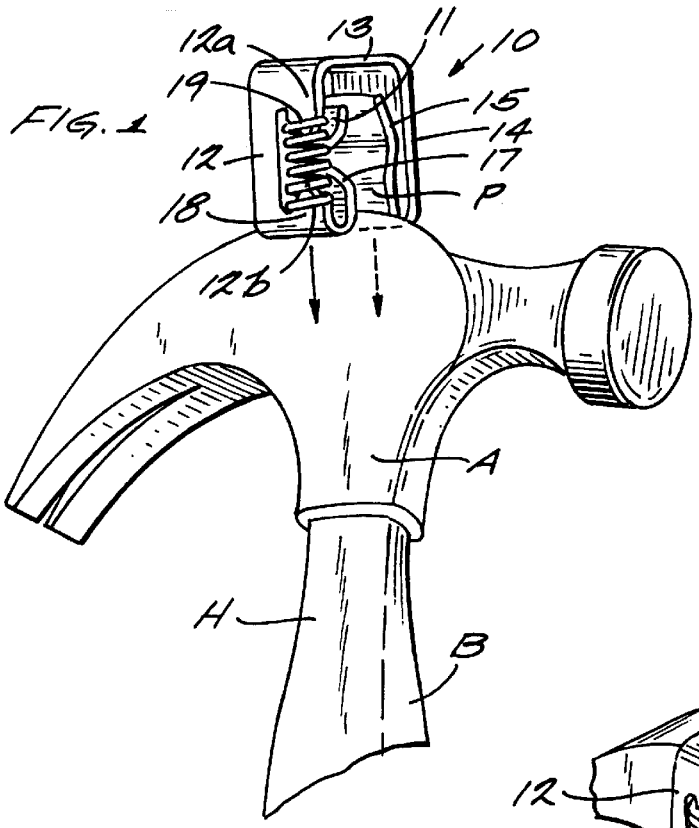
FIG. 1 is a perspective view of a hammer and the nail starter device of the present invention, shown separated from one another.
Figure 2:
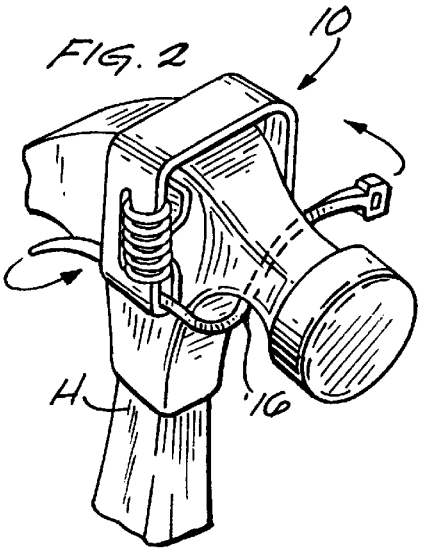
FIG. 2 is a perspective view of a hammer and the nail starter device of the present invention releasably secured to the head of the hammer.

Turning now to the drawings, FIG. 1 shows the nail starter of the present invention generally at 10 as it receives the top portion of the head A of a hammer H. (The hammer also includes an elongate handle B.) In place on the hammer head as shown in FIG. 2, the starter 10 extends from one side face of the hammer head over the top of the head and down the opposite side face of the head.

The nail starter attachment 10 includes a continuous strip made of a resilient material (e.g., a flat strip of stainless steel). It has an inverted U-shaped configuration, defining an inner pocket P and including a first portion 11, a second portion 12, a top portion 13, a third portion 14, and a fourth portion 15. The first and second portions define one leg of the starter 10 and the third and fourth portions define an opposite leg. The inside first and fourth portions have a bowed configuration to facilitate attachment to the hammer head A and to provide a pocket between those portions and the hammer head. This pocket receives the head of a nail N that the starter 10 secures to the hammer H.

Its resilience and its shape allow easy and secure placement of the starter 10 over a hammer head A. To further secure the starter attachment 10 to the hammer head A, a strap 16 extends through the starter 10 and around the hammer head A (see FIGS. 2–4).

The first portion 11 of the nail starter 10 defines a notch 17 and the second portion 12 defines a groove 18. This notch and groove cradle the nail N and allow the nail to extend in a direction generally perpendicular to the side face of the hammer head A.

A helical spring member 19 extends across the groove 18 and releasably secures the nail to the nail starter 10. The spring member is made out of a resilient metal or any other suitable material. Tabs 12*a* and 12*b* extend into the center of the helical spring member and releasably secure the spring member to the nail starter 10. The stabilizing forces provided by the spring member facilitate the driving of the nail into a receiving body S and prevent the nail N from popping out of the position shown in FIG. 3.

Figure 4:
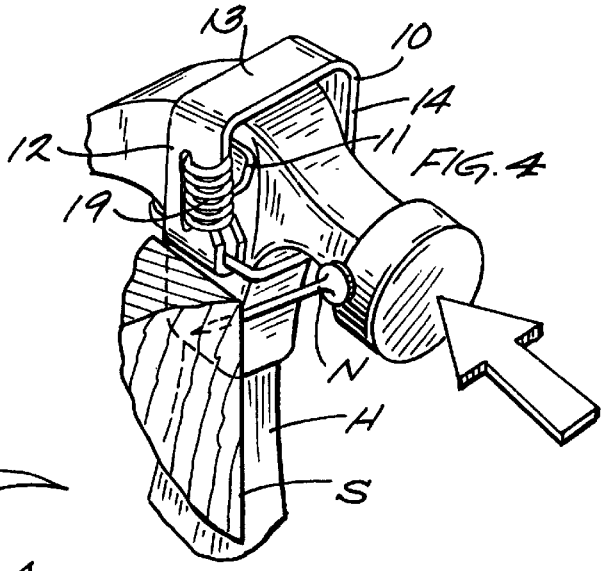
FIG. 4 is a perspective view of the hammer and nail starter device showing the arrangement after the arrangement has released from the nail.
Figure 3:
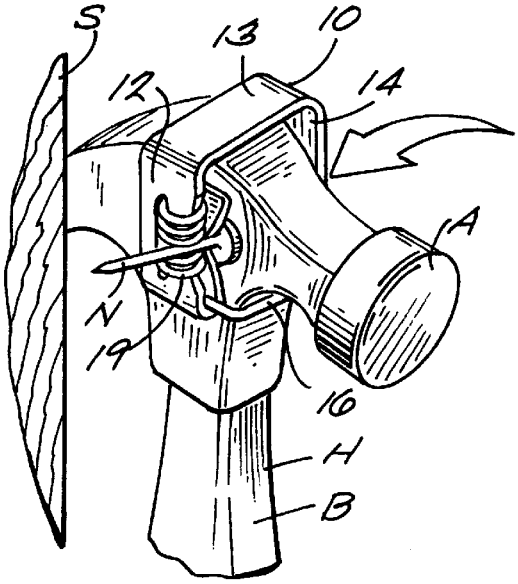
FIG. 3 is a perspective view of the hammer and nail starter device with the device holding a nail on the head of the hammer.
Figure 5:
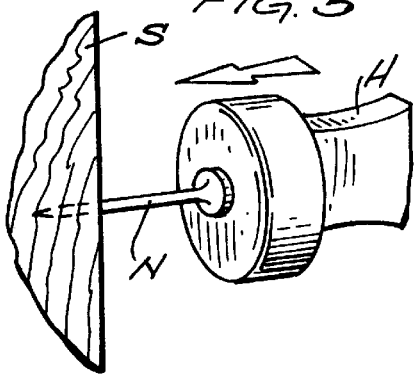
FIG. 5 is a partial perspective view of the hammer driving the nail into a receiving body.

FIGS. 3 through 5 show the process of starting a nail and driving it into a receiving body S. This method includes placing the nail N in position on the hammer head, starting the nail into the receiving body S (see FIG. 3), withdrawing the hammer and nail starter 10 (see FIG. 4), and driving the nail farther into the receiving body S (see FIG. 5).

FIG. 6 shows a second embodiment of the nail starter of the present invention generally at 100. This embodiment does not include a spring member. However, it does include a first portion 101 that includes a V-shaped notch 102 and a second portion 103 that defines a V-shaped notch 104. These portions cradle the nail and maintain it in the position shown in FIG. 5 so that a user may drive the nail N into a supporting body.

FIG. 7 shows yet another embodiment of the nail starter of the present invention including a protrusion 200 which is an integral part of the hammer head A. This protrusion 200 defines a notch 201 and a pocket between its inside surface and the face of the hammer head A. This structure receives a nail as shown in FIG. 8.

FIG. 9 shows a fourth embodiment of the nail starter of the present invention, including integral protrusions 301 and 302 and a spring member 303 disposed between these two protrusions. The pocket between the face of the hammer head A and the spring member 303 receives the head of a nail and adjacent winds of the spring member 303 releasably secure the nail to the hammer head and allow a user to drive the nail into a receiving body.

While the above description and the drawings disclose and illustrate a number of embodiments and modifications, one should understand, of course, that the invention is not limited to these embodiments and modifications. Those skilled in the art to which the invention pertains may make other modifications and other embodiments employing the principles of this invention, particularly upon considering the foregoing teachings. For example, the embodiments shown in FIGS. 7 and 9 may have their protrusions disposed in a recess formed into the head of the hammer. Therefore, by the appended claims, the applicant intends to cover any modifications and other embodiments as incorporate those features which constitute the essential features of this invention.

What is claimed is:

1. A hammer attachment for holding a nail on the head of a hammer, the attachment comprising: a body member defining a pocket for releasably receiving a portion of the hammer; said body member including a first portion for holding a head of a nail against the head of the hammer; and a second portion disposed a spaced distance away from the first portion; said first portion including means for holding a nail outwardly of the head of the hammer along a predetermined direction including a notch formed in an edge of the first portion; and said second portion including means for holding a nail outwardly of the head of the hammer along a predetermined direction including a groove formed in an edge of the second portion, said groove disposed in generally overlapping relation with the notch, wherein the means for holding the nail further includes a spring member secured to the second portion, said spring member extending across the groove for receiving the nail between two adjacent portions of the spring member.

2. The hammer attachment of claim 1, wherein the spring member includes a helical compression spring releasably secured to the second portion.

3. A hammer attachment for holding a nail having a head and a shank on the head of a hammer, the attachment comprising: a body member defining a pocket for releasably receiving a portion of the hammer, said body member including a first elongated portion extending along the head of the hammer; and a second portion disposed a spaced distance laterally away from the first portion; and holding means on the first and second portions of the body member for holding a nail outwardly of the head of the hammer along a predetermined direction, said holding means capturing the head of the nail between the first portion of the body member and the head of the hammer and engaging the shank of the nail at a location spaced from the head of the nail, said holding means including a groove formed in the second portion, and said holding means further including a spring member secured to the second portion, said spring member extending across the groove for receiving the nail between two adjacent portions of the spring member.

4. A hammer attachment for holding a nail on the head of a hammer, the attachment comprising: a body member defining a pocket for releasably receiving a portion of the hammer; said body member including a first portion for holding a head of a nail against the head of the hammer; and a second portion disposed a spaced distance away from the first portion: said second portion including means for holding a nail outwardly of the head of the hammer along a predetermined direction, wherein the means for holding the nail includes a groove formed in the second portion, and wherein the means for holding the nail further includes a spring member secured to the second portion, said spring member extending across the groove for receiving the nail between two adjacent portions of the spring member, wherein the spring member includes a helical compression spring releasably secured to the second portion.

* * * * *